US007857503B2

(12) United States Patent
Realdine

(10) Patent No.: US 7,857,503 B2
(45) Date of Patent: Dec. 28, 2010

(54) TIMEPIECE FOR WATER SPORTS ITEMS AND BEACH ACCESSORIES

(76) Inventor: Joseph Pasquale Realdine, 68-244 Au St., Waialua, HI (US) 96791

( * ) Notice: Subject to any disclaimer, the term of this patent is extended or adjusted under 35 U.S.C. 154(b) by 139 days.

(21) Appl. No.: 11/511,597

(22) Filed: Aug. 28, 2006

(65) Prior Publication Data

US 2007/0047389 A1 Mar. 1, 2007

Related U.S. Application Data

(60) Provisional application No. 60/712,958, filed on Aug. 31, 2005.

(51) Int. Cl.
*G04B 37/00* (2006.01)

(52) U.S. Cl. ..... 368/277; 368/10; 368/276

(58) Field of Classification Search ..... 368/10
See application file for complete search history.

(56) References Cited

U.S. PATENT DOCUMENTS

| | | | | |
|---|---|---|---|---|
| 3,763,646 | A * | 10/1973 | Jeanmonod | 368/277 |
| 4,887,249 | A * | 12/1989 | Thinesen | 368/10 |
| 4,937,920 | A * | 7/1990 | Tsai | 24/3.3 |
| 5,003,637 | A * | 4/1991 | Lonon | 2/160 |
| 5,761,157 | A * | 6/1998 | Takeda et al. | 368/10 |
| 5,775,011 | A * | 7/1998 | Reitano, Jr. | 36/136 |
| 5,828,541 | A | 10/1998 | Wu | |
| 6,007,394 | A * | 12/1999 | Kagan | 441/74 |
| 6,235,668 | B1 | 5/2001 | Chatterjee et al. | |
| D455,039 | S | 4/2002 | Pai | |
| 6,527,434 | B1 | 3/2003 | Fox et al. | |
| 6,729,738 | B2 | 5/2004 | Thompson et al. | |
| 6,812,825 | B1 * | 11/2004 | Volk | 340/309.16 |
| 6,959,259 | B2 * | 10/2005 | Vock et al. | 702/142 |
| 2002/0154574 | A1 * | 10/2002 | Ector et al. | 368/89 |
| 2003/0075208 | A1 * | 4/2003 | McMullin et al. | 135/16 |
| 2005/0111308 | A1 * | 5/2005 | Hosey | 368/317 |
| 2006/0051985 | A1 * | 3/2006 | Chen et al. | 439/67 |
| 2006/0055691 | A1 * | 3/2006 | Bursett | 345/211 |
| 2006/0207907 | A1 * | 9/2006 | Meehan | 206/459.1 |
| 2007/0036037 | A1 * | 2/2007 | Barbeau et al. | 368/316 |
| 2008/0074957 | A1 * | 3/2008 | Koch | 368/282 |

FOREIGN PATENT DOCUMENTS

JP 2001-161419 * 6/2001

OTHER PUBLICATIONS

Intel Surfboard :: intel.com/cd/corporate/pressroom/EMEA/ENG/150308.htm; Jun. 16, 2004.*

* cited by examiner

*Primary Examiner*—Renee S Luebke
*Assistant Examiner*—Sean Kayes

(57) ABSTRACT

A timepiece for the top of a surfboard comprising; a polymer pliable member which can be temporary attached to the top of a surfboard by surface adhesion; and an LCD timepiece affixed to the pliable member, said pliable member having a plurality of folds and snaps such that said pliable member can be formed into a wristwatch band.

21 Claims, 5 Drawing Sheets

Figure 6
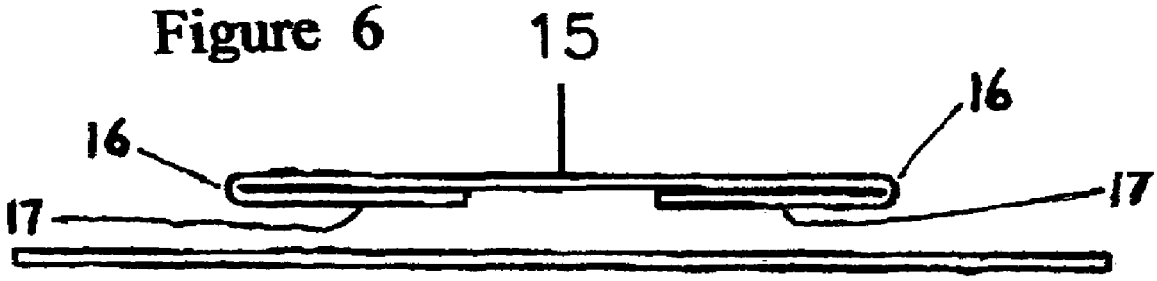
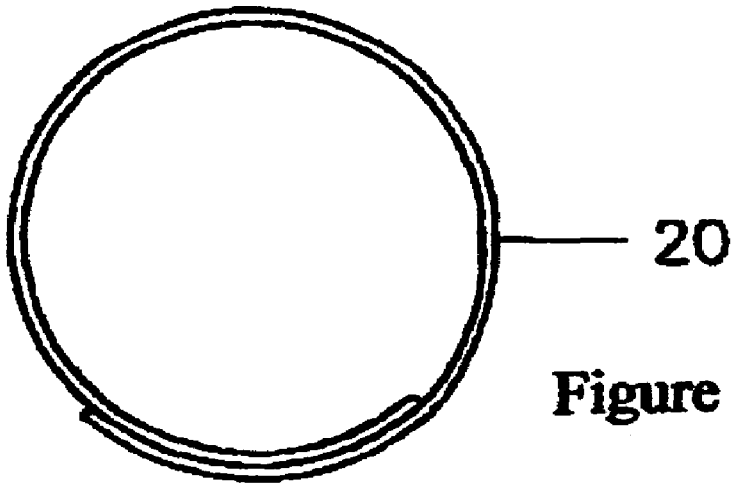
Figure 5

TIMEPIECE FOR WATER SPORTS ITEMS AND BEACH ACCESSORIES

CROSS-REFERENCE TO RELATED APPLICATION

This application claims benefit of U.S. provisional application No. 60/712,958 filed Aug. 31, 2005, the content of which is hereby incorporated by reference in its entirety.

FIELD OF THE INVENTION

The present invention is directed to a novel timepiece used in integration with a surfboard, wake boards, or similar device.

BACKGROUND OF THE INVENTION

There are hundreds of thousands of people surf and ride wakeboards and the like. Recently there have been a number of shark attacks on surfers on both American seaboards and in the Caribbean. Sharks are known to be attracted to shiny objects such as jewelry, rings, and watches.

It is believed to be a cause of shark attacks on surfers is the jewelry worn by the surfer. Expensive watches can also be lost or damaged in the surf. In addition, a surfers watch may cause injury, to ones self, by being thrown around in the surf.

It would be desirable to provide a timepiece which can be attached to the top of a surfboard and which can be attached temporarily or permanently with an adhesive.

It is therefore an object of the present invention to provide a timepiece which can be easily attached to the top of a surfboard, wind surfboard, or wakeboard.

It is a further object of the present invention to provide a timepiece which can be used on beach implement such as a beach umbrella or cooler. These and other objects of the invention will become apparent from the detailed description which follows.

SUMMARY OF THE INVENTION

In accordance with the invention, a timepiece for the top of a surfboard comprising a pliable member permanently attached to the top of a surfboard, and a timepiece affixed to the pliable member.

In a further embodiment, the invention is a timepiece for the top of a surfboard comprising: a polymer pliable member which can be temporary attached to the top of the surfboard by surface adhesion; and a timepiece affixed to the pliable member, said pliable member can be formed into a wristwatch band.

In still a further embodiment, the invention is a timepiece for the top of a surfboard comprising: a polymer pliable member which can be temporarily attached to the top of a surfboard by surface adhesion; and an LCD timepiece affixed to the pliable member can be formed into a wristwatch band.

BRIEF DESCRIPTION OF THE FIGURES

FIG. 5 is a side perspective view of a wrist or belt loop in accordance with the present invention.

FIG. 6 is a side perspective view of a wrist or belt loop in accordance with the present invention.

DETAILED DESCRIPTION OF THE INVENTION

Figures 1, 2:
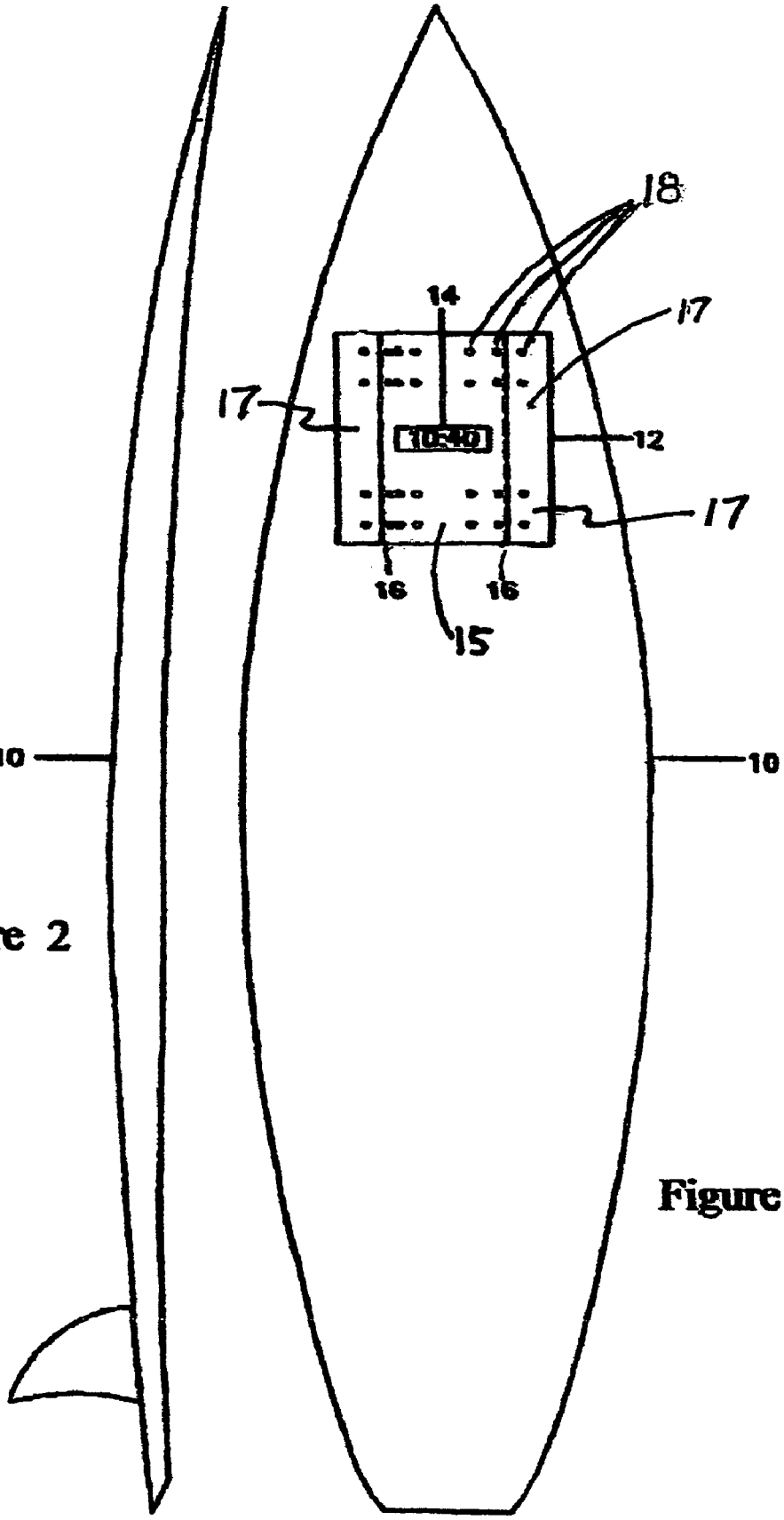
FIG. 1 is an overhead view of the present invention.
FIG. 2 is a side perspective view of the present invention.

The present invention is described with reference to the enclosed figures therein the same numbers are utilized where applicable. Referring to FIG. 1, the present invention is directed to a timepiece 14 which can be attached to a surfboard 10 and which will stick to the top of the board with or without the need for an adhesive. FIG. 2 is a side view as attached to the surfboard, it is very thin and hardly noticeable from the side. While the present invention is described with reference to a surfboard, it is to be noted that the teachings of the invention are applicable to a wide variety of surf and water modalities including so-called wake boards and wind surfboards.

Figure 3:
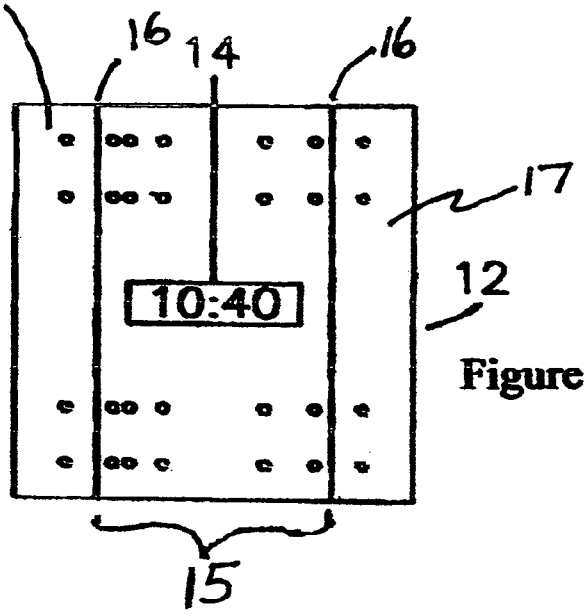
FIG. 3 is a perspective view of the attached timepiece of the present invention.

At the top of the board 10, the timepiece 14 is unlikely to attract sea predators such as sharks or barracudas. The timepiece 14 attaches to a pliable backer 12 and may be attached by an adhesive or wielded. This is illustrated in FIG. 3.

The time piece can comprise a small LCD timepiece which may be welded or cemented to the pliable backer 12. The backer 12 may be constructed from rubber or pliable polymer. The timepiece can also comprise a mechanical timepiece or any other electric or mechanical timepiece and may be powered by light, battery or mechanical means.

Figure 4:
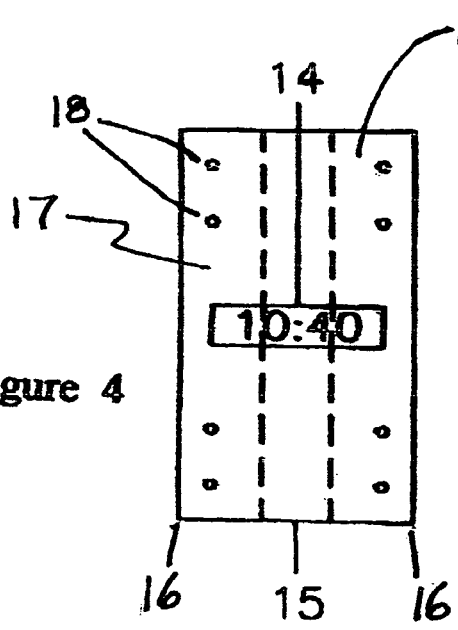
FIG. 4 is a perspective view of the attached timepiece of the present invention.

The rubber or plastic pliable member 12 will attach to the top of the board 10 by means of surface tension adhesive, affixation of an adhesive, affixation of an adhesive or by Velcro, a hook and loop fastener. Pliable member 12 has band portion 15 and fold portion 17. Fold portion 17 is folded along fold-line 16 under strip 10 as shown in FIGS. 4 and 6 to form the wrist band or belt. Pliable member 12 is provided with snaps 18 for forming the pliable member into the wristband or belt. In one embodiment, the timepiece 14 is therefore permanently attached to the board. In a second embodiment, the timepiece 14 may be held by surface adhesive between the top of the board and backer 12.

In the temporary embodiment, when the timepiece is removed, in one embodiment, it may be folded at two locations to form band 15 and be used as a watch. This is illustrated as FIG. 4 and FIG. 6. The folded sections create a wrist or belt loop based watch 20 which can be worn by the user. This is illustrated as FIG. 5.

Figure 7:
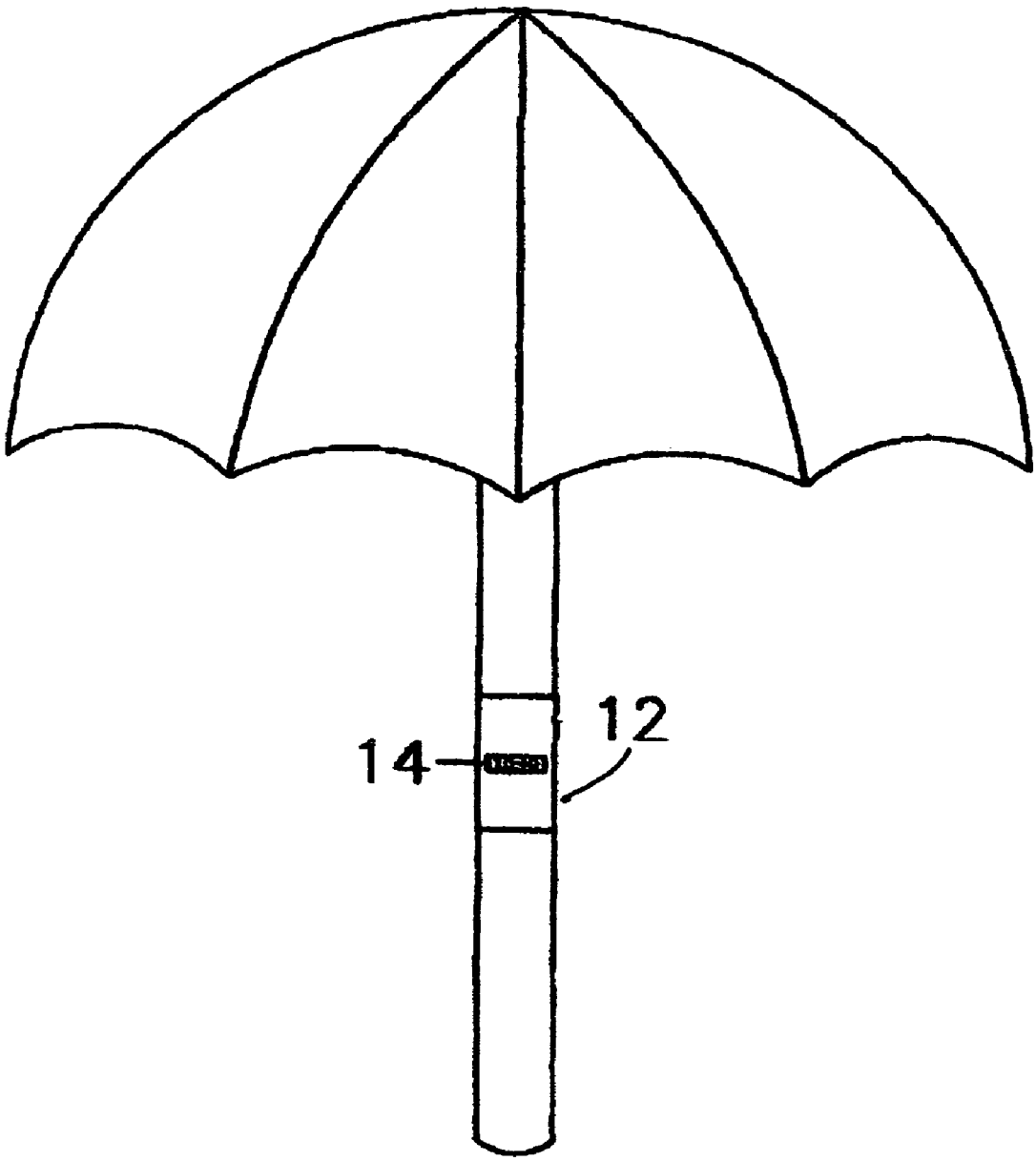
FIG. 7 is a side perspective view of the timepiece used as a beach accessory.
Figure 8:
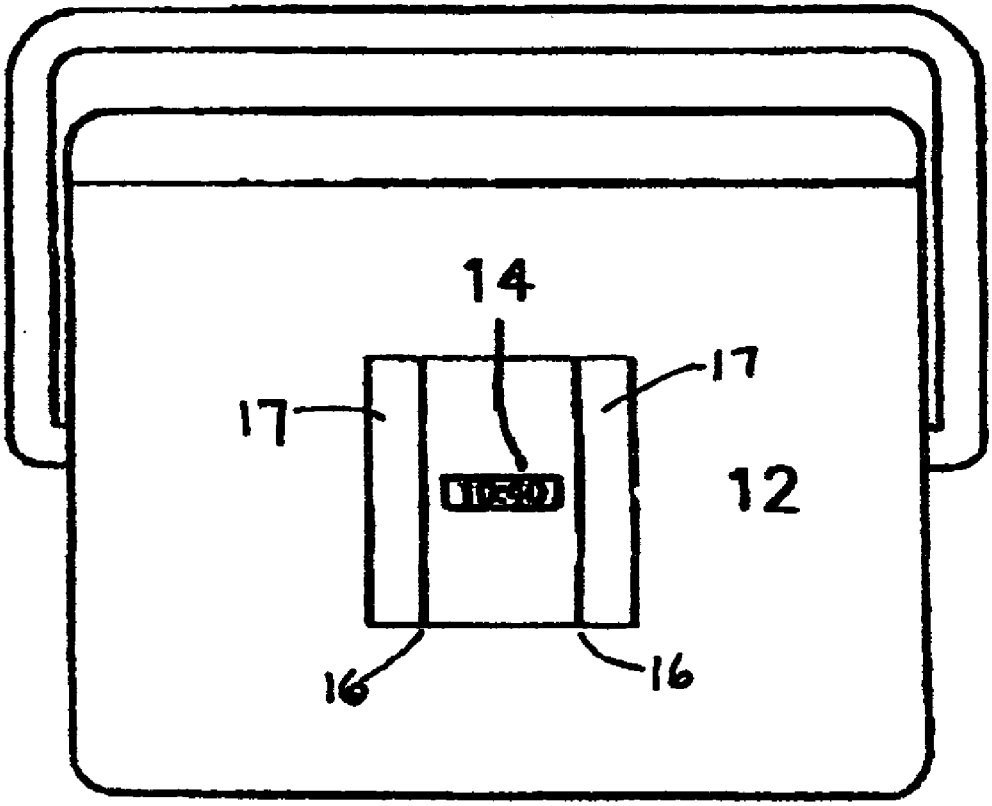
FIG. 8 is a side perspective view of the timepiece used as a beach accessory.

Returning to FIGS. 7 and 8, the invention can be affixed to the side of a beach umbrella or a cooler.

The present invention has been described with reference to the enclosed preferred embodiment. It is to be appreciated that the true nature and scope of the invention is to be understood with reference to the claims appended hereto.

The invention claimed is:

1. A timepiece for the top of a surfboard comprising: a polymer pliable member which can be temporary attached to the top of a surfboard by surface adhesion or hook and loop fastener; and a timepiece affixed to the pliable member, said pliable member having a plurality of folds and snaps such that said pliable member can be formed into a wristwatch band.

2. The timepiece of claim 1 wherein the said timepiece is attached to the top of said surfboard.

3. A timepiece for the top of a surfboard comprising: a polymer pliable member which can be temporary attached to the top of a surfboard by surface adhesion or hook and loop fastener; and a timepiece affixed to the pliable member, said pliable member having either fold means or snap means such that said pliable member can be formed into a wristwatch band.

4. The timepiece of claim 3 wherein said time piece is a LCD timepiece.

5. The timepiece of claim 4 wherein the said timepiece is attached to the top of said surfboard.

6. The time piece of claim 4, wherein the time piece is powered by photo-electricity.

7. The timepiece of claim 3 wherein said surfboard is a wind surfboard.

8. The timepiece of claim 7 wherein said timepiece is attached to the top of said wind surfboard.

9. The timepiece of claim 3 wherein the said timepiece is attached to the top of said surfboard.

10. A timepiece for the top of a wakeboard comprising: a polymer pliable member which can be temporary attached to the top of said wakeboard by surface adhesion or hook and loop fastener; and a timepiece affixed to the pliable member, said pliable member having either fold means or snap means such that said pliable member can be formed into a wrist-watch band.

11. The timepiece of claim 10 wherein the said timepiece is attached to the top of said wakeboard.

12. The timepiece of claims 10, wherein said timepiece is a LCD timepiece.

13. The timepiece of claim 12, wherein the time piece is powered by photo-electricity.

14. A timepiece for an attachment to a beach implement comprising: a polymer pliable member which can be temporary attached to the implement; a timepiece affixed to the pliable member, said pliable member having either fold means or snap means such that said pliable member can be formed into a wristwatch band.

15. The timepiece of claim 14, wherein the implement is a beach umbrella.

16. The timepiece of claim 15, wherein the implement is a cooler.

17. The timepiece of claim 16 wherein the said timepiece is attached to said cooler.

18. The timepiece of claim 15 wherein the said timepiece is attached to said beach umbrella.

19. The timepiece of claim 14 wherein the said timepiece is attached to said beach implement.

20. The timepiece of claim 14, wherein said timepiece is a LCD time piece.

21. The timepiece of claim 20, wherein the time piece is powered by photo-electricity.

* * * * *